US006435751B1

(12) United States Patent
Ono et al.

(10) Patent No.: US 6,435,751 B1
(45) Date of Patent: Aug. 20, 2002

(54) CLICK TYPE WRITING IMPLEMENT

(75) Inventors: Makoto Ono, Tano-gun; Hitoshi Nakamura, Fujioka; Tadashi Koriki, Sawa-gun; Tamotsu Eguchi, Fujioka; Seiichi Kobayashi, Yokohama, all of (JP)

(73) Assignee: Mitsubishi Pencil Kabushiki Kaisha (JP)

( * ) Notice: Subject to any disclaimer, the term of this patent is extended or adjusted under 35 U.S.C. 154(b) by 0 days.

(21) Appl. No.: 09/980,790

(22) PCT Filed: Dec. 26, 2000

(86) PCT No.: PCT/JP00/09264

§ 371 (c)(1),
(2), (4) Date: Dec. 6, 2001

(87) PCT Pub. No.: WO01/60632

PCT Pub. Date: Aug. 23, 2001

(30) Foreign Application Priority Data

Jan. 25, 2000 (JP) ..... 2000-015579

(51) Int. Cl.[7] ..... A46B 11/02
(52) U.S. Cl. ..... 401/188 A; 401/101; 401/99
(58) Field of Search ..... 401/188 A, 188 R, 401/209, 217, 219, 112, 99, 101, 109

(56) References Cited

U.S. PATENT DOCUMENTS 2,432,061 A * 12/1947 Chesler ..... 401/101
3,516,754 A * 6/1970 Blanchard ..... 401/101

FOREIGN PATENT DOCUMENTS

| | | |
|---|---|---|
| JP | 6-7824 | 3/1994 |
| JP | 06-016089 | 3/1994 |
| JP | 10-236062 | 9/1998 |
| JP | 11-165488 | 6/1999 |
| JP | 2000-335173 | 12/2000 |

* cited by examiner

*Primary Examiner*—David J. Walczak
(74) *Attorney, Agent, or Firm*—Burns, Doane, Swecker & Mathis, L.L.P.

(57) ABSTRACT

A click type writing implement includes: a ball-pen refill composed of a point assembly at the front end thereof, an ink storage at the rear thereof and a pressurizing mechanism of a pumping type at the rear of the ink storage; an arrangement for holding the refill and engaging it so as to allow the tip of the point assembly to be projected from and retracted into the front end; and a clicking mechanism for keeping the tip of the point assembly projected, the clicking mechanism comprising: a first clicking mechanism for advancing and contracting ink by a short stroke and a second clicking mechanism for advancing and contracting ink by a large stroke, so that the rear end of ink can be pressurized at two levels so as to promote flow of ink toward the point assembly.

5 Claims, 7 Drawing Sheets

CLICK TYPE WRITING IMPLEMENT

TECHNICAL FIELD

The present invention relates to a ball-point pen employing ink which is likely to cause ink column break at its initial writing, and is mainly directed to a click type writing implement incorporating a ball-point pen refill or the like which is used to correct miswriting by covering it with white ink.

BACKGROUND ART

Conventionally, liquid applicators using white pigments for correcting miswriting and other errors have been known.

Since the white pigments and the solvent are liable to separate, liquid applicators of this type are formed with a flexible container holding ink with a ball or the like sealed therein and they need to be shaken for mixing when used. This type of pen needs to be pressed on the container side in order to eject the ink, so it is a source of irritation that ink cannot be ejected properly by forcibly pressing the container side when a lesser amount of ink is therein. Further, this type of pen has a drawback in that ink may break or skip at its initial writing (application).

Further, attachment and removal of the cap for every usage is also cumbersome.

There also has been proposed a pressurized ball-point pen in which a pressure gas is charged on the rear end side of the ink storage after ink has been filled so as to allow the ball-point pen to write upward by utilizing the internal pressure as a result of the pressurized air charging as well as to prevent ink leakage due to backward flow of ink in the ink storage.

However, pressurized ball-point pens of this type need increased cost for charging the pressurized gas into the ink storage and complicated manufacturing equipment, hence this not only results in low productivity but also needs strict control of assembly parts, their materials and in the sealing performance at the joined portions.

Further, since the ink storage, filled up with ink, is constantly pressurized, there is a fear that a small amount of ink might leak out from the pen point. In order to avoid this, the ink needs to be increased in apparent viscosity, which will give rise to a problem of causing a dull writing sensation and other problems.

Generally, a ball-point pen using ink having a low viscosity or ink presenting thixotropy distributes a large amount of ink (in order to increase the writing density) hence has a large-diametric ink storage to store an increased amount of ink. Further, since the viscosity of such ink is relatively low compared to oil-based ball-point pen ink, its flow resistance with the ink storage is small. Therefore, ink leakage (backward flow of ink toward the rear end of the ink storage) is liable to occur by its own weight, due to being dropped or due to clicking impacts. To avoid this, a greasy follower which will move following the consumption of ink during writing and will inhibit backward flow of ink due to gravity or impacts acting on ink is deployed at the rear end of ink, with a follower rod immersed therein as necessary. However, despite the deployment of such a follower, there is still a risk of a strong backward flow of ink occurring and soiling hands and clothes when ink on the rear side of the ball in the point assembly is used up from upward writing because in this case the ink head will directly act on the follower. Further, since the viscosity of ink is low and hence an ample amount of ink flows out, this ball-point pen has the forward leakage problem, i.e., ink oozes out when the tip is placed down and a gap is formed between the tip ball and the tip holder.

The present invention has been devised in view of the above prior art, and it is therefore an object of the present invention to provide an inexpensive click type writing implement for error correction which incorporates a ball-point pen refill, such as a ball-point pen using an ink that might cause ink column break at its initial writing, for correcting miswriting by covering it with white ink, and is free from the necessity of mixing and cumbersomeness in pushing the side of the container.

In the process of solving the above problem, it was found that it is preferred that the pressure force is made different between when ink is full in the ink storage and when a lesser amount of ink is therein, or when ink column break is light and when ink column break is heavy (strong) and that an excessive amount of ink will eject out if the pressure force is too strong when ink column break is light. So the object of the present invention also includes a countermeasure against this drawback.

DISCLOSURE OF INVENTION

In order to achieve the above objects the present invention is configured as follows:

In accordance with the first aspect of the present invention, a click type writing implement comprises: a ball-pen refill composed of a point assembly at the front end thereof, an ink storage at the rear thereof and a pressurizing mechanism of a pumping type at the rear of the ink storage; and an arrangement for holding the refill and engaging it so as to allow the tip of the point assembly to be projected from and retracted into the front end, and further includes a clicking means for keeping the tip of the point assembly projected and advancing and contracting the pressurizing mechanism, the clicking means being configured so as to make the pressurizing force acting on the rear end of ink variable and promote the flow of ink toward the writing point, and is characterized in that the clicking means comprises: a first clicking means for advancing and contracting ink by a short stroke and a second clicking means for advancing and contracting ink by a large stroke, so that the rear end of ink can be pressurized at two levels.

The second aspect of the present invention resides in the click type writing implement having the above first feature, wherein the refill is configured so that the tip ball is pressed from the rear side thereof by spring pressure so as to be put into sealing contact with the inner brim of the ball holder at the tip of the point assembly and the ink storage is filled up with ink and a follower which follows the rear end of ink.

The third aspect of the present invention resides in the click type writing implement having the above first feature, wherein the pressurizing mechanism is constructed so as to release the pressure-sealed state at the rear end inside the ink storage when the tip of the point assembly is retracted, to thereby establish communication with the outside air.

The fourth aspect of the present invention resides in the click type writing implement having the above first feature, wherein the viscosity of ink is equal to or lower than 1000 mpa·s at a shearing speed of 400/s and equal to or greater than 300 mPa·S at a shearing speed of 5/s, in a 25° C. environment.

The fifth aspect of the present invention resides in the click type writing implement having the above first feature, wherein the ink storage is filled up with a white pigment ink, which at least contains white pigments such as titanium oxide, polymer hollow particles and a gelatinizer so as to prevent sedimentation of the pigments while suppressing the loss of fluidity as low as possible.

BEST MODE FOR CARRYING OUT THE INVENTION

Figure 1:
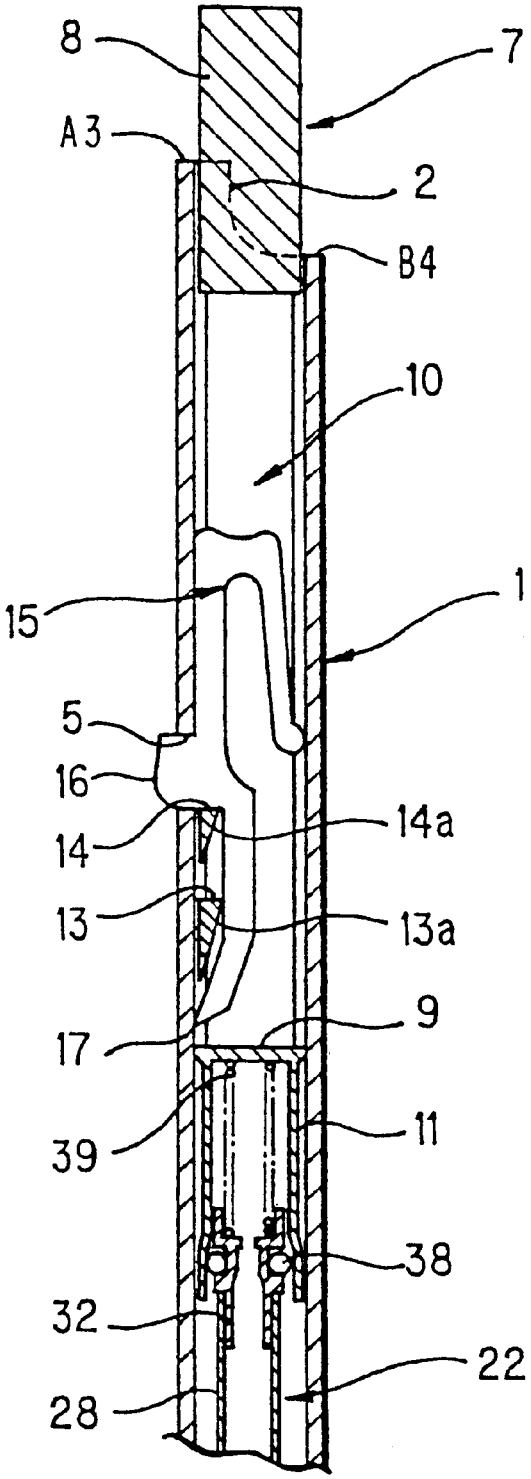
FIG. 1 is a vertical sectional view showing the rear half of a click type writing implement of the present invention when its pen point is retracted from the front end hole of the front barrel.

FIGS. 1 through 7 show one embodiment of the present invention.

To begin with, FIGS. 1 through 7 show a click type writing implement having a ball-point pen refill 22 mounted therein with its pen point retracted.

A barrel cylinder 1 has a cutout portion 2 at its rear end forming stepped ends A3 and B4 with a short window 5 formed at a predetermined site on the barrel side while the front end is formed with a joining portion 6, which removably joins an aftermentioned front barrel 18. This joining portion 6 may be selected depending on the design requirements, e.g., a thread joint, snap-fitting joint which mutually joins the parts or other engagements may be used. It is also possible to integrally extend the front barrel in front of the barrel cylinder if no refill needs to be replaced.

Click rod 7 has a tapered portion 12 at its front opening and a pressurizing cylinder 11 which has an inner peripheral portion 11*a* smoothly extended from the tapered portion and is closed at its rear end by a partitioning wall 9. The click rod further includes, in the rear of the pressurizing cylinder 11, a long slot portion 10 having an elongate rectangular perforation through the rod body perpendicularly to its axis, and a cylindrical portion 8 in the rear end of the long slot portion 10, these elements being integrally joined. Two partitions 13*a* and 14*a* are integrally formed at positions closer to the front on one of the opening sides of long slot portion 10. These partitions have respective stepped portions A13 and B14 on their rear side for holding the engagement piece of the front end of an aftermentioned forked element.

An engagement element 15 (so-called forked element) is formed plate-like and has two forked legs extending forwards. This element is formed of an resin molding which allows the leg on the upper side to elastically spread relative to the leg on the lower side. Further, the leg on the upper side has a push point 16 projected upward at approximately the middle thereof, and an engaging portion 17 at the front end thereof.

In the above manner, engagement element 15 is inserted into long slot portion 10 of click rod 7, is kept so that the leg on the upper side is elastically deformed toward the axis and is inserted together with click rod 7 into barrel cylinder 1 from the cylinder's rear hole. When push point 16 is projected out from window 5 of the barrel cylinder, engagement element 15 is fixed relative to barrel cylinder 1. At this point, the lower portion of the front end of the lower leg of engagement element 15 abuts against the lower wall surface of the bore of the barrel cylinder while the leg on the upper side is urged by its expanding function against the upper wall surface of the bore. The click mechanism made up of the combination of click rod 7 and engagement element 15 is well-known configuration as a forked leg type click mechanism.

The click mechanism will be detailed when describing the operation hereinbelow.

Next, the refill of the ball-point pen will be described.

Figure 7:
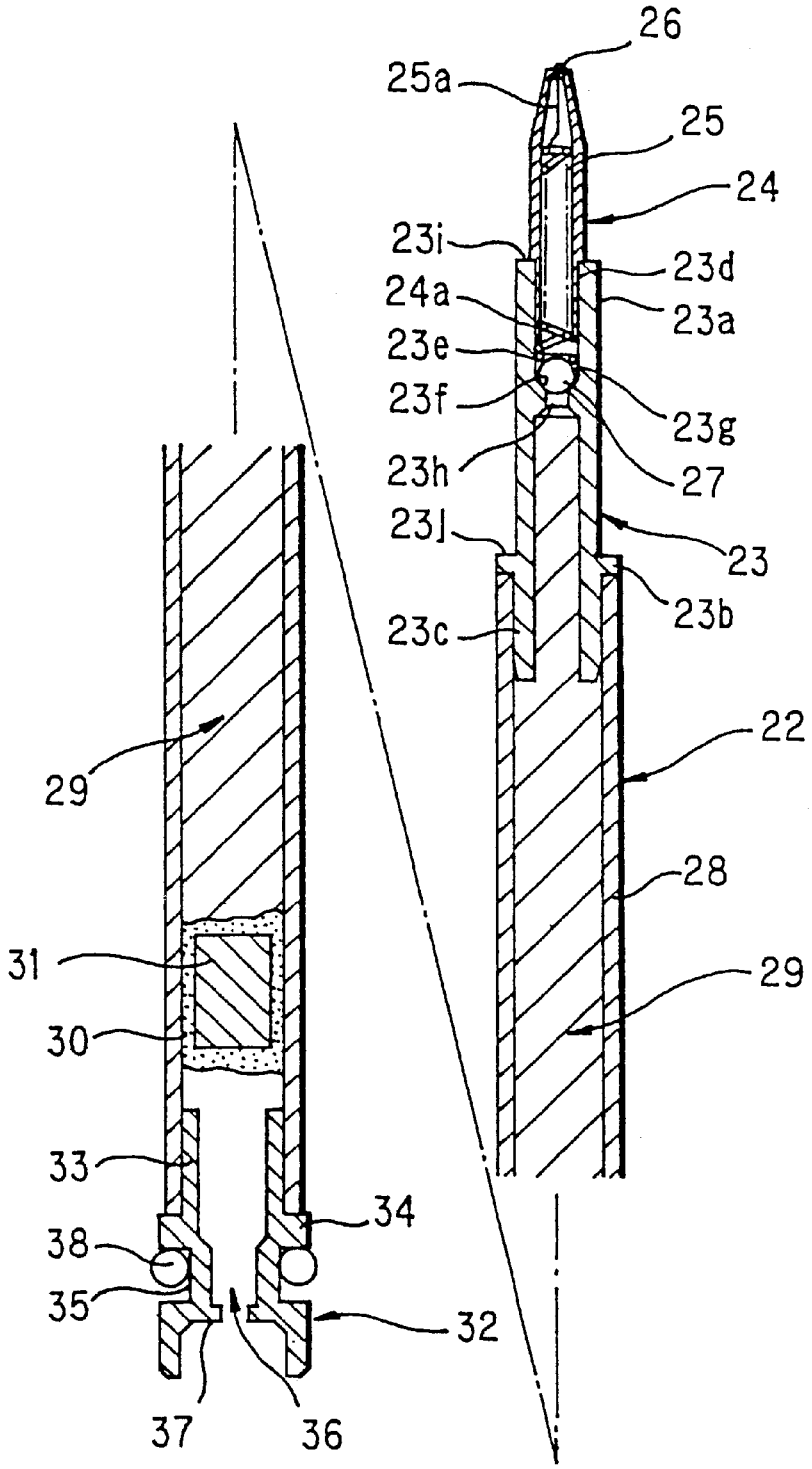
FIG. 7 is a vertical sectional view showing a refill.

As shown in FIG. 7, an ink storage 28 of ball-point pen refill 22 is filled up with white pigment ink 29, and a greasy follower 30 that will follow the ink as it is consumed is put at the rear end of the ink. The follower is incompatible with the ink and has the function of preventing evaporation of ink. A resin-made follower rod 31 having approximately the same specific gravity as the follower is immersed in the follower, as necessary. Here, the follower may employ a follower of silicone rubber, for example.

Examples of ink 29 used in the present invention include oil-based ink, water-based pigment ink, etc., which are liable to cause ink column break at the initial stage of writing. As an example, white pigment ink containing titanium oxide, used as a correction liquid may be used. In this case, the viscosity of the ink is preferably equal to or lower than 1000 mPa·S at a shearing speed of 400/s and equal to or greater than 300 mPa·S at a shearing speed of 5/s, in a 25° C. environment.

The white pigment ink is made up of white pigments such as titanium oxide, polymer hollow particles, etc., a gelatinizer and other components, and is prepared to present thixotropy so as to prevent sedimentation of the pigments while suppressing the loss of fluidity as low as possible, whereby it is possible to provide an ink which provides high hiding power with an aid of being reduced in viscosity as the tip ball rotates during writing.

As shown in the drawings, a joint 23 is comprised of a front tubular portion 23*a* in front of a flange 23*b*, a rear tubular portion 23*c* behind the flange and a point assembly 24 holding tip ball 26 by its tubular portion 24*a* fixed to a point assembly fitting hole 23*d* at the front end of front tubular portion 23*a*.

Further, point assembly 24 is constructed so that tip ball 26 is substantially abutted onto a seat having channels which will permit ink to flow in, and is held rotatably by crimping. A spring 25 is inserted into the bore of point assembly 24. The rear end of tubular portion 24*a* of the point assembly is appropriately crimped so that the rear end of spring 25 will not come out.

A straight rod portion 25*a* is extended forwards from spring 25 so that the front end of the rod portion 25*a* abuts the rear side of tip ball 26 to urge it. This pressure causes tip ball 26 to come into sealing contact with the inner brim of the ball holder (formed by crimping or the like) of point assembly 24. In connection with this, a pressing piece for pressing the rear side of tip ball 26 may be provided at the front side of the spring. Or the rod portion may be formed of an extra fine coil. Further, the point assembly may be formed of a resin molding excellent in wear resistance and ink-sealing performance, and an integral or separated spring seat may be provided to press the rear side of the tip ball.

It is very important to bring tip ball 26 into sealing contact with the inner surface of the ball holder in order to prevent dryout of the writing tip and forward leakage of ink, even though a high-viscosity ink is used.

That is, the ball-point pen of the present application, which is mainly used for error correction application, is designed to have a greater distance for allowing the tip ball to move backward than that of ball-point pens for writing, in order to increase the ejected amount of ink. Further, as required, in order to improve the surface roughness of the inner surface of the point assembly that holds tip ball 26 and the precision of the sealing contact by crimping, the ground finish to the inner surface and the secondary plastic forming for improving the accuracy of crimping should be considered. Further, the surface treatment etc. of the contact surf ace with the tip ball should be considered, if required.

Provided in the rear of the point assembly fitting hole 23*d* is a valve chamber 23*e* which is appropriately set off the axis of point assembly 24. The rear part of valve chamber 23*e* is defined by a tapered or spherical valve seat 23*f* which is connected to a conduit 23*h*. Formed on one side of the inner wall of valve chamber 23*e* is a channel portion 23*g* through which ink can flow in. A spherical valve element 27 is loosely held in valve chamber 23*e*. With point assembly 24 put downwards, valve element 27 abuts off-centered against the rear end of tubular portion 24*a* so that the ink-lead by way of the channel portion 23*g*, etc., from conduit 23*h* will flow into the point assembly bore.

The valve element may be a cylindrical element shaped in a tapered or spherical form on its side in close contact with the valve seat. In this case, if a channel which allows ink to flow into the point assembly is formed on the peripheral surface on the side in contact with the tubular rear end of the point assembly, it is not necessary to set the valve chamber off the axis of the point assembly as above.

Further, rear tubular portion 23*c* is extended behind flange 23*b* of joint 23 while cylindrical ink storage 28 is squeeze fitted on the outer periphery of rear tubular portion 23*c* with its front end in abutment with the rear side of flange 23*b*. Ink storage 28 may be formed by a transparent PP resin molding, as an example. In the embodiment, the joint and the ink storage are formed separately but these two parts may be formed by a uni-body resin article.

A tail plug 32 as one of the constituents of a pressurizing mechanism is provided at the rear end of ink storage 28. Tail plug 32 is composed of a front cylindrical portion 33 to be fixed to the rear end hole of ink storage 28 and a rear cylindrical portion 34 having an outer diameter substantially equal to that of ink storage 28. Formed on the rear end side of cylindrical portion 34 is a stepped portion 37 with an air hole 36 at the center. This air hole 36 establishes communication between the front and rear sides of tail plug 32. Formed on the outer periphery of cylindrical portion 34 is an annular groove 35, to which a sealing element 38 is fitted. Sealing element 38 may be formed of, for example, an elastic material such as rubber or an elastic resin molding. That is, one which presents good air tightness and smoothness is selected. It is also considered that a lubricant may be applied. The sealing portion may also be formed integrally on the inner periphery of the pressing cylinder.

Thus, refill 22 is configured.

Next, the arrangement of mounting refill 22 on the click type writing implement will be described.

Figure 2:
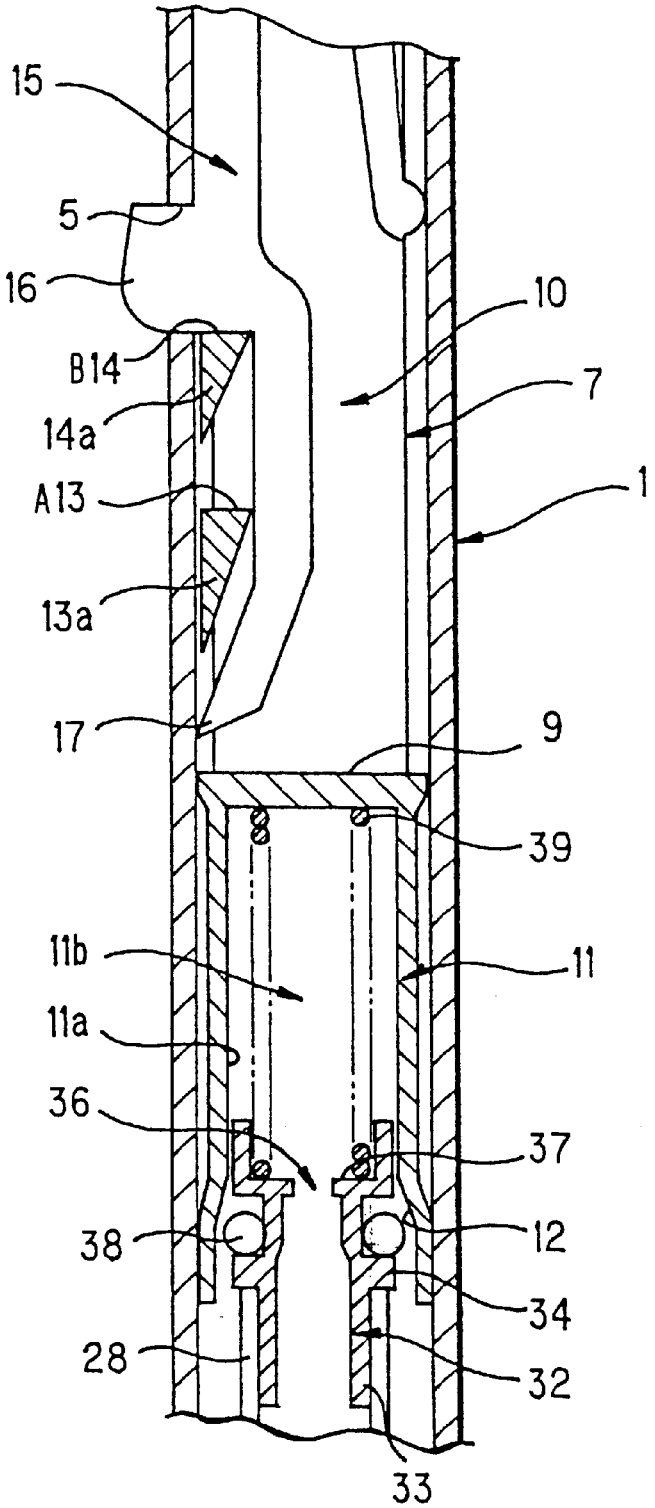
FIG. 2 is an enlarged view showing essential parts in FIG. 1.
Figure 3:
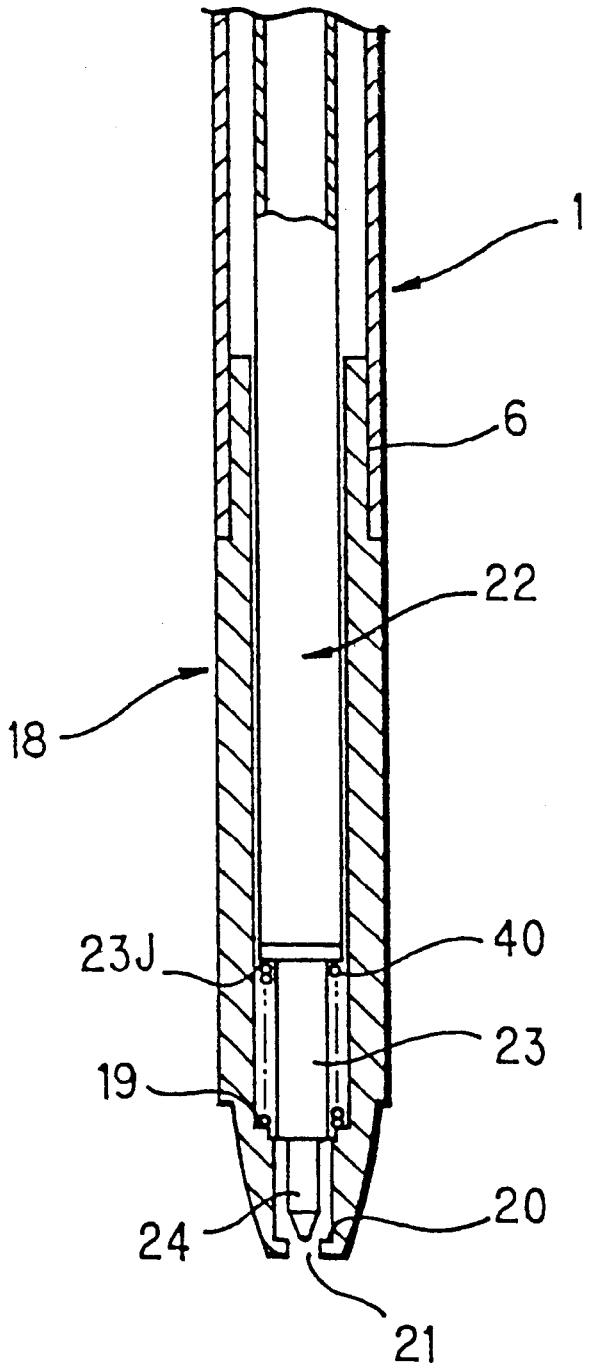
FIG. 3 is a vertical partially sectional view showing the state corresponding to FIG. 1, where its pen point is retracted from the front end hole of the front barrel.

As shown in FIGS. 1 and 2, refill 22 is inserted rear end first into the bore of barrel cylinder 1. Since a spring 39 is disposed between the stepped portion 37 of the tail plug and partitioning wall 9 at the rear end of pressurizing cylinder 11 of click rod 7, refill 22 is pressed forward in the barrel cylinder when it is inserted. Subsequently, a return spring 40 is arranged between a stepped portion 23*j* of refill joint 23 and an inner stepped portion 19 in front barrel 18 as shown in FIG. 3, so that front barrel 18 is fixed to the front part of barrel cylinder 1 with refill 22 urged rearwards relative to front barrel 18.

This state shows the storage state of the click type writing implement with its pen point retracted inside its tip opening 21 of the front barrel or when it is carried.

The urging force of the spring 39 is set greater than that of return spring 40, appropriately so that spring 39 will not substantially contract until the pen point becomes engaged at the projected position from tip opening 21, whereby seal element 38 is positioned keeping the small clearance from pressurizing cylinder 11, as shown in FIG. 2, to establish communication of air between the pressurizing cylinder interior and the outside air.

That is, when click rod 7 is moved forwards to some degree with refill 22 stopped from advancing, the peripheral part of sealing element 38 slides into hermetic contact with the inner periphery 11*a* of the pressurizing cylinder 11 to shut off the external air and contract and pressurize the internal space 11*b* inside pressurizing cylinder. This will be detailed in the description of the operation.

It should be understood that the refill does not necessarily include the valve element disposed inside the joint or the follower rod in the follower either. This will be detailed in the description of the operation.

The pressurizing mechanism is comprised of tail plug 32, sealing element 38, spring 39 and pressurizing cylinder 11 and these elements are split on both the refill 22 side and click rod 7 side in the above embodiment. However, all the elements can be put on only one of the sides.

Next, the operation of the present invention will be described.

Figure 4:
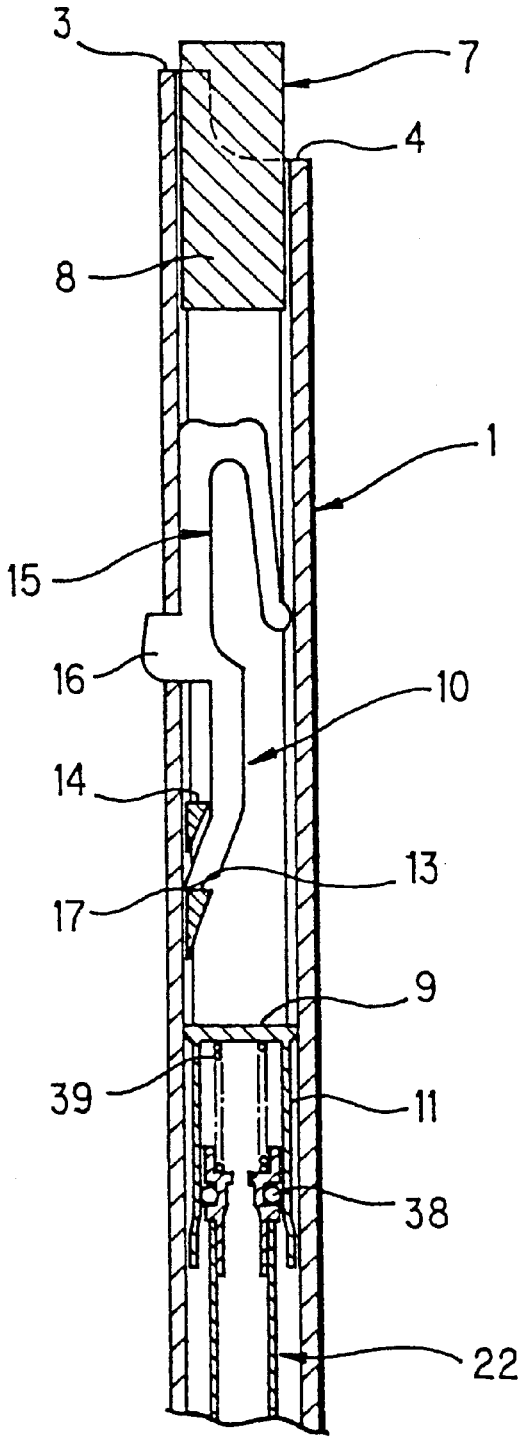
FIG. 4 is a vertical sectional view showing the rear half of the click type writing implement where the rear end has been clicked to set it into the first clicked state, which corresponds to the state where its pen point is projected out from the front end hole of the front barrel.
Figure 5:
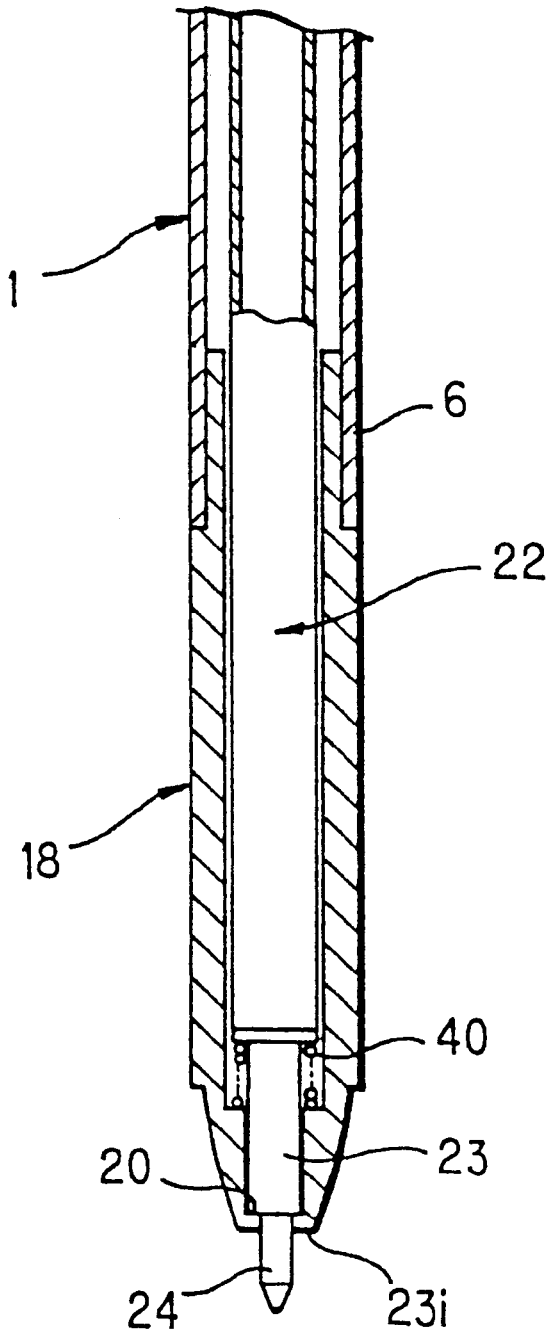
FIG. 5 is a vertical sectional view showing a state where the pen point is projected out from the front end hole of the front barrel.

First, FIGS. 1 through 3 show the click type writing implement with its storage state or in the carried state. When click rod 7 is pushed forward from this state up to the end A3 at the rear end of the barrel cylinder and released, front engaging portion 17 at the front end of engaging element 15 becomes engaged with stepped portion A13 of the click rod, as shown in FIG. 4. In this state, refill 22 advances with its pen point (point assembly 24) projected from tip opening 21 to allow writing, as shown in FIG. 5.

Whether communication of air between the pressurizing cylinder interior and the outside air should be established or shut off can be selected depending on the design requirements.

When click rod 7 is pushed to the same level with the end A3 at the rear end of the barrel cylinder, stepped portion 23*i* of joint 23 comes into abutment with the stepped portion 20 inside the tip of front barrel 18 so that refill 22 is stopped from advancing. At this stage, the communication of air between the pressurizing cylinder interior and the outside air is shut off and the space 11*b* inside the pressurizing cylinder contracts by a small stroke to pressurize the rear end of follower 30 hence promote the flowability of ink to the point assembly side. This provides the function of preventing broken delivery of ink flow due to separation of ink from the spherical surface of the tip ball due to impacts from being dropped, poor fluidity of ink and this also provides the function of recovery when ink column break has occurred.

This is the first clicking means.

Figure 6:
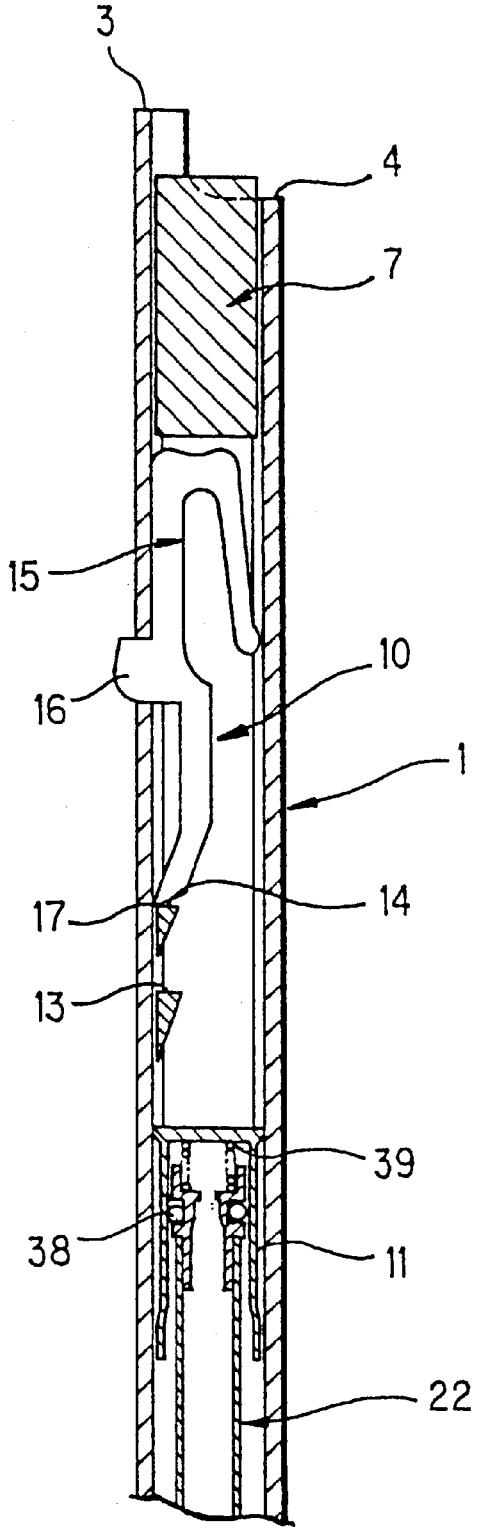
FIG. 6 is a vertical sectional view showing the rear half of the click type writing implement where the rear end has been clicked to set it into the second clicked state.

When click rod 7 is pushed forward up to the end B4 at the rear end of the barrel cylinder and released, engaging portion 17 at the front end of engaging element 15 becomes engaged with stepped portion B14 of the click rod, as shown in FIG. 6. The space 11*b* inside the pressurizing cylinder contracts by a greater stroke to pressurize the rear end of follower 30, thus making it possible to promote the flowability of ink toward the point assembly side when the degree of ink discontinuation is large (strong) or when the amount of ink left in the ink storage is low. In this condition, by repeating the click and release of the rear end of click rod 7 to the same level to the end A3 at the rear end of the barrel cylinder, a pressure wave is applied to the rear end of follower 30, thus further promoting the flow of ink toward the point assembly side. This is the second clicking means.

Release of the engagement between the stepped portion of click rod 7 and engaging portion 17 of engagement element 15 can be allowed by pressing push point 16 toward the axis of the barrel cylinder 1.

Next, the basic function of refill 22 will be described.

First, when the pen is not used to write, spring 25 presses tip ball 26 into sealing contact with the inner brim of the tip holder so that it is possible to prevent forward and backward leakage of ink 29.

When tip ball 26 is slightly moved backwards by the writing pressure, a gap is created which allows ink to flow out. As tip ball 26 rotates during writing, ink flows out, allowing writing. When point assembly 24 is set upwards, valve element 27 comes into close contact with valve seat 23*f* and seals conduit 23*h*. Therefore, no ink will flow backward even if ink behind tip ball 26 is used up during upward writing. Accordingly, as soon as point assembly 24 is turned downward ink is able to flow out, thus making it possible to prevent ink break. Incidentally, with a configuration having no valve element, ink head acts in the backward direction during upward writing, so that air is drawn into the point assembly, causing the problem of ink being unable to follow immediately after the pen is returned to the downward writing position. Further, repetition of upward writing causes the problem of drawn-in air gradually building up.

Follower rod 31 may be used when the ink storage is large in diameter. Follower 30 in the form of grease is subject to being affected by impacts and is easy to be broken when the ink storage is large in diameter. Immersion of a resin-made follower rod, having a specific gravity approximately equal to that of the follower, in the follower makes it possible to enhance the rigidity.

Since tip ball 26 is always put in sealing contact with the inner brim of the ball holder, it is possible to prevent ink starvation due to dryout at the tip. Since drawing of air due to being used in upward writing or due to impacts can be inhibited by cooperation of tip ball 26 and valve element 27, ink column break can be prevented. Forward leakage and backward flow of ink is prevented by pressing the tip ball 26 with spring 25. Imperfect sealing between the ball holder and tip ball 26 due to variance in manufacturing the ball holder or imperfect sealing caused by a foreign substance clinging to the gap between the ball holder and tip ball 26 is compensated by the spring so as to support the strong head of ink, assure prevention of backflow of ink and inhibit air from being drawn in.

The aforementioned anti ink-backflow mechanism using a follower rod and a valve element will exhibit its performance when ink is liable to flow backward due to a large diameter of the ink storage portion, or when the pen is repeatedly used with its pen tip upward or when the pen undergoes impacts. Therefore, this mechanism is not essential as a constituent. In particular, a ball-point pen for error correction will hardly be used with its pen tip upward, so that the mechanism is not always necessary.

INDUSTRIAL APPLICABILITY

The click type writing implement of the present invention is thus configured with the configuration and operation as described above. That is, the ball-point pen employing ink which is likely to cause ink column break at its initial writing is improved in writing performance by the assistance of the pressurizing means which is variable in pressurizing level.

Further, according to the present invention, the viscosity of ink is set equal to or lower than 1000 mpa·s at a shearing speed of 400/s and equal to or greater than 300 mPa·S at a shearing speed of 5/s, in a 25° C. environment. Thus, the ink viscosity is set lower than that of conventional pressurizing type ball-point pens, so that it is possible to select and use various kinds of ink and provide an improved writing comfort.

Use of a white pigment ink, which at least contains white pigments such as titanium oxide, polymer hollow particles and a gelatinizer so as to prevent sedimentation of the pigments while suppressing the loss of fluidity as low as possible, in combination with the pressurizing mechanism, makes it possible to solve the problem of the white pigments and solvent becoming separated, which would occur in the conventional configuration. Thus, this configuration can provide a convenient, click type writing implement for error correction which is free from cumbersome handling such as ink mixing, pressing the side of container upon writing and attachment and removal of the cap.

What is claimed is:

1. A click type writing implement comprising:

a ball-pen refill composed of a point assembly at a front end thereof, an ink storage at a rear thereof and a pressurizing mechanism of a pumping type at a rear of the ink storage; and an arrangement for holding the refill and engaging the refill so as to allow a tip of the point assembly to be projected from and retracted into a front end of the writing implement, further including a clicking means for keeping the tip of the point assembly projected and advancing and contracting the pressurizing mechanism, the clicking means being configured so as to make a pressurizing force act on a rear end of ink and promote the flow of the ink toward a writing point, characterized in that the clicking means comprises: a first clicking means for advancing and contracting the ink by a short stroke and a second clicking means for advancing and contracting the ink by a large stroke, so that the rear end of the ink can be pressurized at two levels.

2. The click type writing implement according to claim 1, wherein the refill is configured so that a tip ball is pressed from a rear side thereof by spring pressure so as to be put into sealing contact with an inner brim of a ball holder at the tip of the point assembly and the ink storage is filled up with the ink and a follower which follows the rear end of the ink.

3. The click type writing implement according to claim 1, wherein the pressurizing mechanism is constructed so as to release a pressure-sealed state at a rear end inside the ink storage when the tip of the point assembly is retracted, to thereby establish communication with the outside air.

4. The click type writing implement according to claim 1, wherein the viscosity of ink is equal to or lower than 1000 mPa·s at a shearing speed of 400/s and equal to or greater than 300 mPa·S at a shearing speed of 5/s, in a 25° C. environment.

5. The click type writing implement according to claim 1, wherein the ink storage is filled up with a white pigment ink, which at least contains white pigments such as titanium oxide, polymer hollow particles and a gelatinizer so as to prevent sedimentation of the pigments while suppressing loss of fluidity as low as possible.

* * * * *